US007396449B2

(12) United States Patent
Powers

(10) Patent No.: US 7,396,449 B2
(45) Date of Patent: Jul. 8, 2008

(54) OLEFIN PRODUCTION UTILIZING CONDENSATE FEEDSTOCK

(75) Inventor: Donald H. Powers, Houston, TX (US)

(73) Assignee: Equistar Chemicals, LP, Houston, TX (US)

( * ) Notice: Subject to any disclaimer, the term of this patent is extended or adjusted under 35 U.S.C. 154(b) by 314 days.

(21) Appl. No.: 11/365,212

(22) Filed: Mar. 1, 2006

(65) Prior Publication Data

US 2007/0208207 A1 Sep. 6, 2007

(51) Int. Cl.
*C10G 9/16* (2006.01)

(52) U.S. Cl. ..... 208/130; 208/105; 208/125; 208/132; 585/652; 585/648; 585/650

(58) Field of Classification Search ..... 208/130, 208/132; 585/647, 652
See application file for complete search history.

(56) References Cited

U.S. PATENT DOCUMENTS

| | | | | |
|---|---|---|---|---|
| 5,580,443 | A | 12/1996 | Yoshida et al. | 208/130 |
| 5,817,226 | A | 10/1998 | Lenglet | 208/130 |
| 6,743,961 | B2 | 6/2004 | Powers | 585/648 |
| 6,979,757 | B2 * | 12/2005 | Powers | 585/648 |
| 7,019,187 | B2 | 3/2006 | Powers | 585/648 |
| 7,244,871 | B2 * | 7/2007 | Stell et al. | 585/648 |
| 7,351,872 | B2 * | 4/2008 | Stell et al. | 585/652 |
| 7,358,413 | B2 * | 4/2008 | Stell et al. | 585/652 |
| 2004/0004022 | A1 | 1/2004 | Stell et al. | 208/106 |

FOREIGN PATENT DOCUMENTS

| | | | |
|---|---|---|---|
| WO | WO 2005/113717 | A2 | 12/2005 |
| WO | WO 2005/113717 | A3 | 12/2005 |
| WO | WO 2005/113718 | A2 | 12/2005 |
| WO | WO 2005/113718 | A3 | 12/2005 |
| WO | WO 2006/078159 | A1 | 7/2006 |
| WO | WO 2007/030276 | A1 | 3/2007 |
| WO | PCT/US2007/004197 | | 9/2007 |

* cited by examiner

*Primary Examiner*—Tam M Nguyen
(74) *Attorney, Agent, or Firm*—Roderick W. MacDonald

(57) ABSTRACT

A method for utilizing natural gas condensate as a feedstock for an olefin production plant wherein the feedstock is subjected to vaporization and separation conditions that remove light hydrocarbons from the condensate for thermal cracking in the plant, and leave liquid distillate for separate recovery.

7 Claims, 2 Drawing Sheets

OLEFIN PRODUCTION UTILIZING CONDENSATE FEEDSTOCK

BACKGROUND OF INVENTION

1. Field of Invention

This invention relates to the formation of olefins by thermal cracking of liquid condensate derived from natural gas. More particularly, this invention relates to utilizing natural gas condensate as a feedstock for an olefin production plant that employs hydrocarbon thermal cracking in a pyrolysis furnace.

2. Description of the Prior Art

Thermal (pyrolysis) cracking of hydrocarbons is a non-catalytic petrochemical process that is widely used to produce olefins such as ethylene, propylene, butenes, butadiene, and aromatics such as benzene, toluene, and xylenes.

Basically, a hydrocarbon feedstock such as naphtha, gas oil or other fractions of whole crude oil that are produced by distilling or otherwise fractionating whole crude oil, is mixed with steam which serves as a diluent to keep the hydrocarbon molecules separated. The steam/hydrocarbon mixture is preheated to from about 900 to about 1,000 degrees Fahrenheit (° F. or F), and then enters the reaction zone where it is very quickly heated to a severe hydrocarbon thermal cracking temperature in the range of from about 1,450 to about 1,550 F. Thermal cracking is accomplished without the aid of any catalyst.

This process is carried out in a pyrolysis furnace (steam cracker) at pressures in the reaction zone ranging from about 10 to about 30 psig. Pyrolysis furnaces have internally thereof a convection section and a radiant section. Preheating is accomplished in the convection section, while severe cracking occurs in the radiant section.

After severe thermal cracking, the effluent from the pyrolysis furnace contains gaseous hydrocarbons of great variety, e.g., from one to thirty-five carbon atoms per molecule. These gaseous hydrocarbons can be saturated, monounsaturated, and polyunsaturated, and can be aliphatic, alicyclics, and/or aromatic. The cracked gas also contains significant amounts of molecular hydrogen (hydrogen).

Thus, conventional steam (thermal) cracking, as carried out in a commercial olefin production plant, employs a fraction of whole crude and totally vaporizes that fraction while thermally cracking same. The cracked product can contain, for example, about 1 weight percent (wt. %) hydrogen, about 10 wt. % methane, about 25 wt. % ethylene, and about 17 wt. % propylene, all wt. % being based on the total weight of said product, with the remainder consisting mostly of other hydrocarbon molecules having from 4 to 35 carbon atoms per molecule.

The cracked product is then further processed in the olefin production plant to produce, as products of the plant, various separate individual streams of high purity such as hydrogen, ethylene, propylene, mixed hydrocarbons having four carbon atoms per molecule, fuel oil, and pyrolysis gasoline. Each separate individual stream aforesaid is a valuable commercial product in its own right. Thus, an olefin production plant currently takes a part (fraction) of a whole crude stream and generates a plurality of separate, valuable products therefrom.

Natural gas and whole crude oil(s) were formed naturally in a number of subterranean geologic formations (formations) of widely varying porosities. Many of these formations were capped by impervious layers of rock. Natural gas and whole crude oil (crude oil) also accumulated in various stratigraphic traps below the earth's surface. Vast amounts of both natural gas and/or crude oil were thus collected to form hydrocarbon bearing formations at varying depths below the earth's surface. Much of this natural gas was in close physical contact with crude oil, and, therefore, absorbed a number of lighter molecules from the crude oil.

When a well bore is drilled into the earth and pierces one or more of such hydrocarbon bearing formations, natural gas and/or crude oil can be recovered through that well bore to the earth's surface.

The terms "whole crude oil" and "crude oil" as used herein means liquid (at normally prevailing conditions of temperature and pressure at the earth's surface) crude oil as it issues from a wellhead separate from any natural gas that may be present, and excepting any treatment such crude oil may receive to render it acceptable for transport to a crude oil refinery and/or conventional distillation in such a refinery. This treatment would include such steps as desalting. Thus, it is crude oil that is suitable for distillation or other fractionation in a refinery, but which has not undergone any such distillation or fractionation. It could include, but does not necessarily always include, non-boiling entities such as asphaltenes or tar. As such, it is difficult if not impossible to provide a boiling range for whole crude oil. Accordingly, whole crude oil could be one or more crude oils straight from an oil field pipeline and/or conventional crude oil storage facility, as availability dictates, without any prior fractionation thereof.

Natural gas, like crude oil, can vary widely in its composition as produced to the earth's surface, but generally contains a significant amount, most often a major amount, i.e., greater than about 50 weight percent (wt. %), methane. Natural gas often also carries minor amounts (less than about 50 wt. %), often less than about 20 wt. %, of one or more of ethane, propane, butane, nitrogen, carbon dioxide, hydrogen sulfide, and the like. Many, but not all, natural gas streams as produced from the earth can contain minor amounts (less than about 50 wt. %), often less than about 20 wt. %, of hydrocarbons having from 5 to 12, inclusive, carbon atoms per molecule (C5 to C12) that are not normally gaseous at generally prevailing ambient atmospheric conditions of temperature and pressure at the earth's surface, and that can condense out of the natural gas once it is produced to the earth's surface. All wt. % are based on the total weight of the natural gas stream in question.

When various natural gas streams are produced to the earth's surface, a hydrocarbon composition often naturally condenses out of the thus produced natural gas stream under the then prevailing conditions of temperature and pressure at the earth's surface where that stream is collected. There is thus produced a normally liquid hydrocarbonaceous condensate separate from the normally gaseous natural gas under the same prevailing conditions. The normally gaseous natural gas can contain methane, ethane, propane, and butane. The normally liquid hydrocarbon fraction that condenses from the produced natural gas stream is generally referred to as "condensate," and generally contains molecules heavier than butane (C5 to about C20 or slightly higher). After separation from the produced natural gas, this liquid condensate fraction is processed separately from the remaining gaseous fraction that is normally referred to as natural gas.

Thus, condensate recovered from a natural gas stream as first produced to the earth's surface is not the exact same material, composition wise, as natural gas (primarily methane). Neither is it the same material, composition wise, as crude oil. Condensate occupies a niche between normally gaseous natural gas and normally liquid whole crude oil. Condensate contains hydrocarbons heavier than normally gaseous natural gas, and a narrow range of hydrocarbons that are at the lightest end of whole crude oil.

Condensate, unlike crude oil, can be characterized by way of its boiling point range. Condensates normally boil in the range of from about 100 to about 650 degrees Fahrenheit (F). With this boiling range, condensates contain a wide variety of hydrocarbonaceous materials. These materials can include compounds that make up fractions that are commonly referred to as naphtha, kerosene, diesel fuel(s), and gas oil (fuel oil, furnace oil, heating oil, and the like). Naphtha and associated lighter boiling materials (naphtha) are in the C5 to C10, inclusive, range, and are the lightest boiling range fractions in condensate, boiling in the range of from about 100 to about 400 F. Petroleum distillates (kerosene, diesel, gas oil) are generally in the C10 to about C20 or slightly higher range, and generally boil, in their majority, in the range of from about 350 to about 650 F. They are, individually and collectively, referred to herein as "distillate" or "distillates". It should be noted that various distillate compositions can have a boiling point lower than 350 F and/or higher than 650 F, and such distillates are included in the 350-650 F range aforesaid, and in this invention.

The starting feedstock for a conventional olefin production plant, as described above, normally has first been subjected to substantial, expensive processing before it reaches that plant. Normally, condensate and whole crude oil is distilled or otherwise fractionated into a plurality of fractions such as gasoline, naphtha, kerosene, gas oil (vacuum or atmospheric) and the like, including, in the case of crude oil and not natural gas, a high boiling residuum. Thereafter any of these fractions, other than the residuum, are normally passed to an olefin production plant as the starting feedstock for that plant.

It would be desirable to be able to forego the capital and operating cost of a refinery distillation unit (whole crude processing unit) that processes condensate and/or crude oil to generate a hydrocarbonaceous fraction that serves as the starting feedstock for conventional olefin producing plants. However, the prior art, until recently, taught away from even hydrocarbon cuts (fractions) that have too broad a boiling range distribution. For example, see U.S. Pat. No. 5,817,226 to Lenglet.

Recently, U.S. Pat. No. 6,743,961 issued to Donald H. Powers. This patent relates to cracking whole crude oil by employing a vaporization/mild cracking zone that contains packing. This zone is operated in a manner such that the liquid phase of the whole crude that has not already been vaporized is held in that zone until cracking/vaporization of the more tenacious hydrocarbon liquid components is maximized. This allows only a minimum of solid residue formation which residue remains behind as a deposit on the packing. This residue is later burned off the packing by conventional steam air decoking, ideally during the normal furnace decoking cycle, see column 7, lines 50-58 of that patent. Thus, the second zone 9 of that patent serves as a trap for components, including hydrocarbonaceous materials, of the crude oil feed that cannot be cracked or vaporized under the conditions employed in the process, see column 8, lines 60-64 of that patent.

U.S. patent application Ser. No. 10/244,792, filed Sep. 16, 2002, having common inventorship and assignee with U.S. Pat. No. 6,743,961, is directed to the process disclosed in that patent but which employs a mildly acidic cracking catalyst to drive the overall function of the vaporization/mild cracking unit more toward the mild cracking end of the vaporization (without prior mild cracking)—mild cracking (followed by vaporization) spectrum.

U.S. Pat. No. 6,979,757, having common inventorship and assignee with U.S. Pat. No. 6,743,961, is directed to the process disclosed in that patent but which removes at least part of the liquid hydrocarbons remaining in the vaporization/mild cracking unit that are not yet vaporized or mildly cracked. These liquid hydrocarbon components of the crude oil feed are drawn from near the bottom of that unit and passed to a separate controlled cavitation device to provide additional cracking energy for those tenacious hydrocarbon components that have previously resisted vaporization and mild cracking. Thus, that invention also seeks to drive the overall process in the vaporization/mild cracking unit more toward the mild cracking end of the vaporization—mild cracking spectrum aforesaid.

U.S. patent application Ser. No. 11/219,166, filed Sep. 2, 2005, having common inventorship and assignee with U.S. Pat. No. 6,743,961, is directed to the process of using whole crude oil as the feedstock for an olefin plant to produce a mixture of hydrocarbon vapor and liquid. The vaporous hydrocarbon is separated from the remaining liquid and the vapor passed to a severe cracking operation. The liquid hydrocarbon remaining is subjected to conditions that favor vaporization over mild cracking by introducing a quenching oil into the unit, and withdrawing from that unit a liquid residuum composed of quenching oil and remaining liquid hydrocarbons from the crude oil feed.

During periods of increased gasoline demand the gasoline supply (pool) can be increased by subjecting various crude oil fractions, including distillates, to various refinery catalytic cracking processes such as fluid catalytic cracking. Thus, the quantity of gasoline/naphtha produced from a barrel of crude oil can be increased if desired. This is not so with distillates as defined above. The amount of distillate recovered from a barrel of crude oil is fixed and cannot be increased as it can with gasoline. The only way to increase distillate production (supply) is by refining additional barrels of crude oil.

Thus, there are times when it is highly desirable to recover distillates from what would otherwise be feed for a thermal cracking furnace that forms olefins from such feed, and this invention provides just such a process.

By the use of this invention, valuable distillates that are in short supply can be separately recovered from a cracking feed and thus saved from being converted to less valuable cracked products. By this invention, not only is high quality distillate saved from cracking, but it is done so with greater thermal efficiency and lower capital expense than the approach that would have been obvious to one skilled in the art. One skilled in the art would first subject the feed to be cracked to a conventional thermal distillation column to distill the distillate from the cracking feed. This approach would require a substantial amount of capital to build the column and outfit it with the normal reboiler and overhead condensation equipment that goes with such a column. By this invention, a splitter is employed in a manner such that much greater energy efficiency at lower capital cost is realized over a distillation column. By this invention, reboilers, overhead condensers, and related distillation column equipment are eliminated without eliminating the functions thereof, thus saving considerably in capital costs. Further, this invention exhibits much greater energy efficiency in operation than a distillation column because the extra energy that would be required by a distillation column is not required by this invention since this invention instead utilizes for its splitting function the energy that is already going to be expended in the operation of the cracking furnace (as opposed to energy expended to operate a standalone distillation column upstream of the cracking furnace), and the vapor product of the splitter goes directly to the cracking section of the furnace.

SUMMARY OF THE INVENTION

In accordance with this invention, there is provided a process for utilizing condensate as the feedstock for an olefin plant, as defined above, which maximizes the recovery of distillate, as defined above, and leaves as feed for the olefin plant, materials lower in boiling temperature than distillate.

Pursuant to this invention, condensate is preheated to produce a mixture of hydrocarbon vapor and liquid distillate from the condensate feedstock with little or no coke formation. The vaporous hydrocarbon is then separated from the remaining liquid distillate, and the vapor passed on to a severe cracking operation. The liquid distillate remaining is separately recovered for addition to the distillate supply (pool).

DETAILED DESCRIPTION OF THE INVENTION

Figure 1:
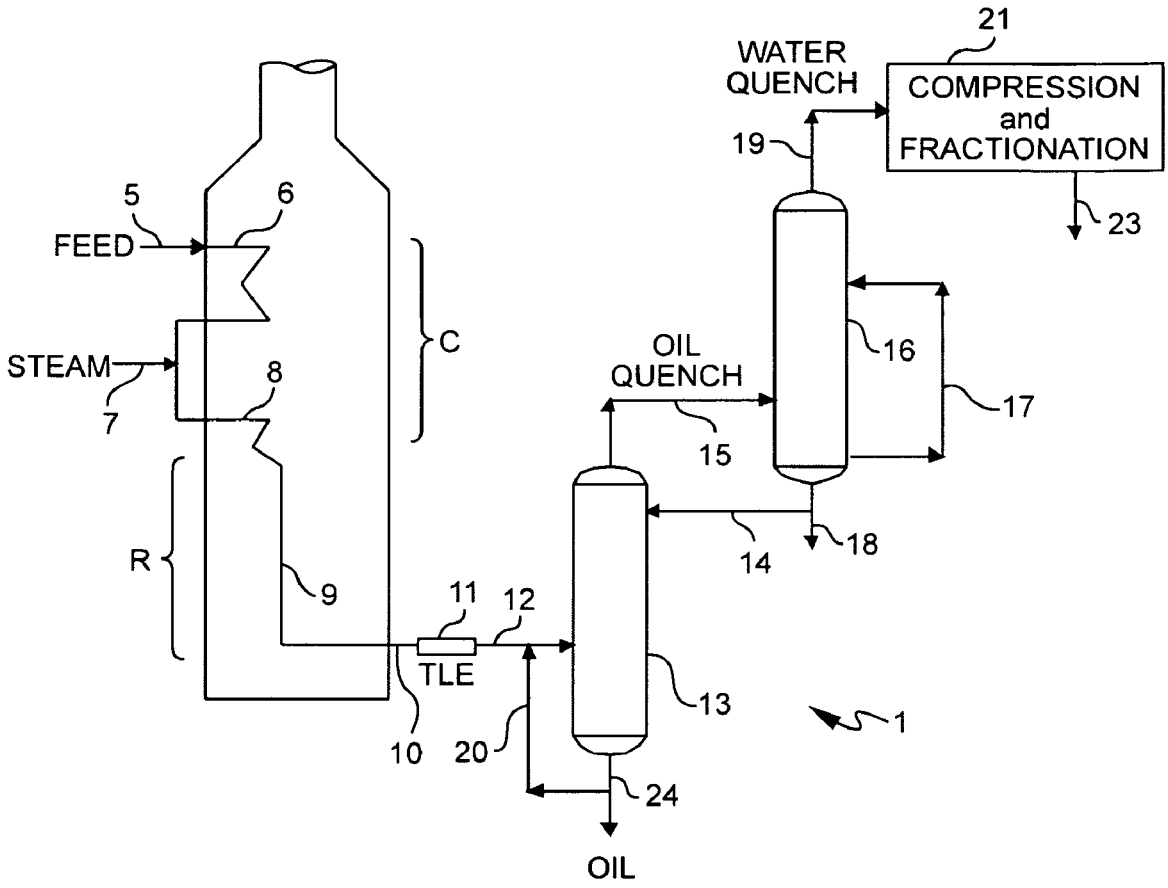
FIG. 1 (PRIOR ART)
FIG. 1 shows a simplified flow sheet for a typical hydrocarbon cracking plant.

The terms "hydrocarbon," "hydrocarbons," and "hydrocarbonaceous" as used herein do not mean materials strictly or only containing hydrogen atoms and carbon atoms. Such terms include materials that are hydrocarbonaceous in nature in that they primarily or essentially are composed of hydrogen and carbon atoms, but can contain other elements such as oxygen, sulfur, nitrogen, metals, inorganic salts, and the like, even in significant amounts.

The term "gaseous" as used in this invention means one or more gases in an essentially vaporous state, for example, steam alone, a mixture of steam and hydrocarbon vapor, and the like.

The term "coke" as used in this invention means any high molecular weight carbonaceous solid, and includes compounds formed from the condensation of polynuclear aromatics.

An olefin producing plant useful with this invention would include a pyrolysis (thermal cracking) furnace for initially receiving and cracking the feed. Pyrolysis furnaces for steam cracking of hydrocarbons heat by means of convection and radiation, and comprise a series of preheating, circulation, and cracking tubes, usually bundles of such tubes, for preheating, transporting, and cracking the hydrocarbon feed. The high cracking heat is supplied by burners disposed in the radiant section (sometimes called "radiation section") of the furnace. The waste gas from these burners is circulated through the convection section of the furnace to provide the heat necessary for preheating the incoming hydrocarbon feed. The convection and radiant sections of the furnace are joined at the "cross-over," and the tubes referred to hereinabove carry the hydrocarbon feed from the interior of one section to the interior of the next.

Cracking furnaces are designed for rapid heating in the radiant section starting at the radiant tube (coil) inlet where reaction velocity constants are low because of low temperature. Most of the heat transferred simply raises the hydrocarbons from the inlet temperature to the reaction temperature. In the middle of the coil, the rate of temperature rise is lower but the cracking rates are appreciable. At the coil outlet, the rate of temperature rise increases somewhat but not as rapidly as at the inlet. The rate of disappearance of the reactant is the product of its reaction velocity constant times its localized concentration. At the end of the coil, reactant concentration is low and additional cracking can be obtained by increasing the process gas temperature.

Steam dilution of the feed hydrocarbon lowers the hydrocarbon partial pressure, enhances olefin formation, and reduces any tendency toward coke formation in the radiant tubes.

Cracking furnaces typically have rectangular fireboxes with upright tubes centrally located between radiant refractory walls. The tubes are supported from their top.

Firing of the radiant section is accomplished with wall or floor mounted burners or a combination of both using gaseous or combined gaseous/liquid fuels. Fireboxes are typically under slight negative pressure, most often with upward flow of flue gas. Flue gas flow into the convection section is established by at least one of natural draft or induced draft fans.

Radiant coils are usually hung in a single plane down the center of the fire box. They can be nested in a single plane or placed parallel in a staggered, double-row tube arrangement. Heat transfer from the burners to the radiant tubes occurs largely by radiation, hence the thermo "radiant section," where the hydrocarbons are heated to from about 1,450° F. to about 1,550° F. and thereby subjected to severe cracking.

The initially empty radiant coil is, therefore, a fired tubular chemical reactor. Hydrocarbon feed to the furnace is preheated to from about 900° F. to about 1,000° F. in the convection section by convectional heating from the flue gas from the radiant section, steam dilution of the feed in the convection section, or the like. After preheating, in a conventional commercial furnace, the feed is ready for entry into the radiant section.

In a typical furnace, the convection section can contain multiple zones. For example, the feed can be initially preheated in a first upper zone, boiler feed water heated in a second zone, mixed feed and steam heated in a third zone, steam superheated in a fourth zone, and the final feed/steam mixture preheated to completion in the bottom, fifth zone. The number of zones and their functions can vary considerably. Thus, pyrolysis furnaces can be complex and variable structures.

The cracked gaseous hydrocarbons leaving the radiant section are rapidly reduced in temperature to prevent destruction of the cracking pattern. Cooling of the cracked gases before further processing of same downstream in the olefin production plant recovers a large amount of energy as high pressure steam for re-use in the furnace and/or olefin plant. This is often accomplished with the use of transfer-line exchangers that are well known in the art.

Radiant coil designers strive for short residence time, high temperature and low hydrocarbon partial pressure. Coil lengths and diameters are determined by the feed rate per coil, coil metallurgy in respect of temperature capability, and the rate of coke deposition in the coil. Coils range from a single, small diameter tube with low feed rate and many tube coils per furnace to long, large-diameter tubes with high feed rate and fewer coils per furnace. Longer coils can consist of lengths of tubing connected with u-turn bends. Various combinations of tubes can be employed. For example, four narrow tubes in parallel can feed two larger diameter tubes, also in parallel, which then feed a still larger tube connected in series. Accordingly, coil lengths, diameters, and arrangements in series and/or parallel flow can vary widely from furnace to furnace. Furnaces, because of proprietary features in their design, are often referred to by way of their manufacturer. This invention is applicable to any pyrolysis furnace, including, but not limited to, those manufactured by Lummus, M. W. Kellog & Co., Mitsubishi, Stone & Webster Engineering Corp., KTI Corp., Linde-Selas, and the like.

Downstream processing of the cracked hydrocarbons issuing from the furnace varies considerably, and particularly based on whether the initial hydrocarbon feed was a gas or a liquid. Since this invention uses liquid natural gas condensate as a feed, downstream processing herein will be described for a liquid fed olefin plant. Downstream processing of cracked gaseous hydrocarbons from liquid feedstock, naphtha through gas oil for the prior art, and condensate for this invention, is more complex than for gaseous feedstock because of the heavier hydrocarbon components present in the liquid feedstocks.

With a liquid hydrocarbon feedstock downstream processing, although it can vary from plant to plant, typically employs an oil quench of the furnace effluent after heat exchange of same in, for example, the transfer-line exchanger aforesaid. Thereafter, the cracked hydrocarbon stream is subjected to primary fractionation to remove heavy liquids, followed by compression of uncondensed hydrocarbons, and acid gas and water removal therefrom. Various desired products are then individually separated, e.g., ethylene, propylene, a mixture of hydrocarbons having four carbon atoms per molecule, fuel oil, pyrolysis gasoline, and a high purity hydrogen stream.

In accordance with this invention, a process is provided which utilizes condensate liquid that has not been subjected to fractionation, distillation, and the like, as the primary (initial) feedstock for the olefin plant pyrolysis furnace in whole or in substantial part. By so doing, this invention eliminates the need for costly distillation of the condensate into various fractions, e.g., from naphtha, kerosene, gas oil, and the like, to serve as the primary feedstock for a furnace as is done by the prior art as first described hereinabove.

By this invention, the foregoing advantages (energy efficiency and capital cost reduction) while using condensate as a primary feed are accomplished. In so doing, complete vaporization of the hydrocarbon stream that is passed into the radiant section of the furnace is achieved while preserving distillate fractions initially present in the liquid condensate feed essentially in the liquid state for easy separation of same from the lighter, vaporous hydrocarbons that are to be cracked.

This invention can be carried out using a self-contained vaporization facility that operates separately from and independently of the convection and radiant sections, and can be employed as (1) an integral section of the furnace, e.g., inside the furnace in or near the convection section but upstream of the radiant section and/or (2) outside the furnace itself but in fluid communication with the furnace. When employed outside the furnace, condensate primary feed is preheated in the convection section of the furnace, passed out of the convection section and the furnace to a standalone vaporization facility. The vaporous hydrocarbon product of this standalone facility is then passed back into the furnace to enter the radiant section thereof. Preheating can be carried out other than in the convection section of the furnace if desired or in any combination inside and/or outside the furnace and still be within the scope of this invention.

The vaporization unit of this invention receives the condensate feed that may or may not have been preheated, for example, from about ambient to about 350 F, preferably from about 200 to about 350 F. This is a lower temperature range than what is required for complete vaporization of the feed. Any preheating preferably, though not necessarily, takes place in the convection section of the same furnace for which such condensate is the primary feed.

Thus, the first zone in the vaporization operation step of this invention employs vapor/liquid separation wherein vaporous hydrocarbons and other gases, if any, in the preheated feed stream are separated from those distillate components that remain liquid after preheating. The aforesaid gases are removed from the vapor/liquid separation section and passed on to the radiant section of the furnace.

Vapor/liquid separation in this first, e.g., upper, zone knocks out distillate liquid in any conventional manner, numerous ways and means of which are well known and obvious in the art. Suitable devices for liquid vapor/liquid separation include liquid knock out vessels with tangential vapor entry, centrifugal separators, conventional cyclone separators, schoepentoeters, vane droplet separators, and the like.

Figure 2:
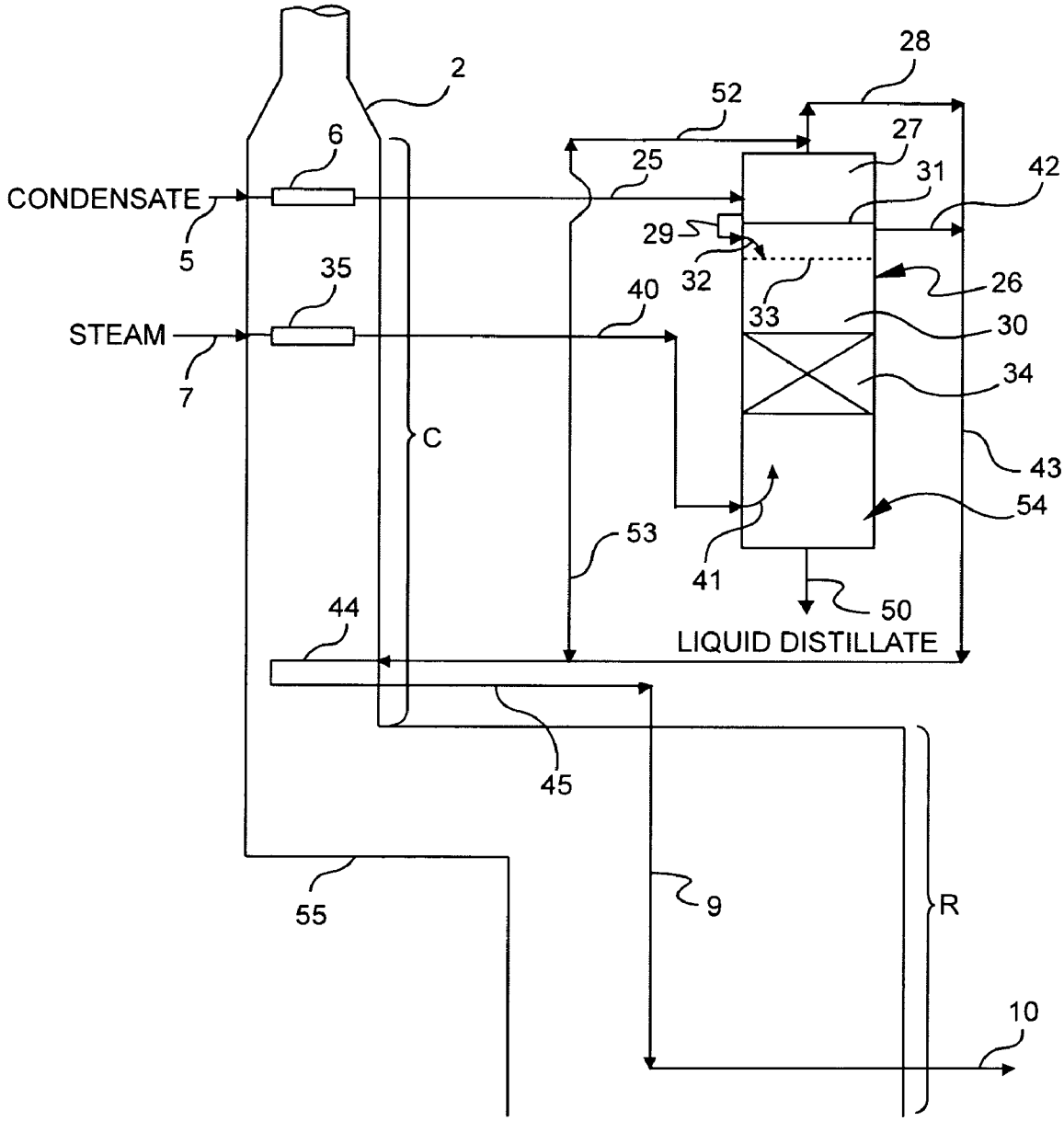
FIG. 2 shows one embodiment within this invention, this embodiment employing a standalone vaporization unit.

Liquid thus separated from the aforesaid vapors moves into a second, e.g., lower, zone. This can be accomplished by external piping as shown in FIG. 2 hereinafter. Alternatively this can be accomplished internally of the vaporization unit. The liquid entering and traveling along the length of this second zone meets oncoming, e.g., rising, steam. This liquid, absent the removed gases, receives the full impact of the oncoming steam's thermal energy and diluting effect.

This second zone can carry at least one liquid distribution device such as a perforated plate(s), trough distributor, dual flow tray(s), chimney tray(s), spray nozzle(s), and the like.

This second zone can also carry in a portion thereof one or more conventional tower packing materials and/or trays for promoting intimate mixing of liquid and vapor in the second zone.

As the remaining liquid hydrocarbon travels (falls) through this second zone, lighter materials such as gasoline or naphtha that may be present can be vaporized in substantial part by the high energy steam with which it comes into contact. This enables the hydrocarbon components that are more difficult to vaporize to continue to fall and be subjected to higher and higher steam to liquid hydrocarbon ratios and temperatures to enable them to be vaporized by both the energy of the steam and the decreased liquid hydrocarbon partial pressure with increased steam partial pressure.

FIG. 1 shows a typical cracking operation (plant) 1 wherein furnace 2 has an upper convection section C and a lower radiant section R joined by a crossover (see FIG. 2). Feed 5, e.g., naphtha, is to be cracked in furnace 2, but, before cracking, to ensure essentially complete vaporization, it is first preheated in zone 6, then mixed with dilution steam 7, and the resulting mixture heated further in zone 8 which is in a hotter area of section C than is zone 6. The resulting vapor mixture is then passed into radiant section R and distributed to one or more radiant coils 9. The cracked gas product of coil 9 is collected and passed by way of line 10 to a plurality of transfer line exchangers 11 (TLE in FIG. 1) where the cracked gas product is cooled to the extent that the thermal cracking function is essentially terminated. The cracked gas product is further cooled by injection of recycled cooled quench oil 20 immediately downstream of TLE 11. The quench oil and gas mixture passes via line 12 to oil quench tower 13. In tower 13 it is contacted with a hydrocarbonaceous liquid quench material such as pyrolysis gasoline from line 14 to further cool the cracked gas product as well as condense and recover additional fuel oil product. Part of product 24 is recycled, after some additional cooling (not shown), via line 20 into line 12. Cracked gas product is removed from tower 13 via line 15 and passed to water quench tower 16 wherein it is contacted with recycled and cooled water 17 that is recovered from a lower portion of tower 16. Water 17 condenses out a liquid hydrocarbon fraction in tower 16 that is, in part, employed as liquid quench material 14, and, in part, removed via line 18 for other processing elsewhere. The part of quench oil fraction 24 that is not passed into line 20 is removed as fuel oil and processed elsewhere.

The thus processed cracked gas product is removed from tower 16 and passed via line 19 to compression and fractionation facility 21 wherein individual product streams aforesaid are recovered as products of plant 1, such individual product streams being collectively represented by way of line 23.

FIG. 2 shows one embodiment of the application of the process of this invention to furnace 2 of FIG. 1. FIG. 2 is very diagrammatic for sake of simplicity and brevity since, as discussed above, actual furnaces are complex structures. In FIG. 2, furnace 2 is shown to have initial or primary condensate feed stream 5 entering preheat section 6. Feed 5 can consist essentially only of (primarily of) condensate, but need not be entirely condensate. Other hydrocarbonaceous materials can be present in feed 5 in minor amounts, particularly materials that are lighter boiling than condensate such as natural gas liquids, butane(s), natural gasoline, and the like. Feed 5 may be mixed with diluting steam (not shown) for reasons described hereinabove before it enters section 6 and/or interiorly of section 6. Section 6 is a typical pre-heat section of a conventional furnace. In this invention, preheating is optional, so section 6 can be eliminated in its entirety. If preheating is used, it can be employed outside furnace 2 in lieu of or in addition to section 6. Thus, the use of a typical preheat section inside a conventional furnace can be used or eliminated in the practice of this invention, and, similarly, feed 5 preheat can be used or eliminated. In one embodiment of the invention, feed 5 passes through section 6 and when heated into the desired temperature range aforesaid leaves section 6 by way of line 25. In a conventional olefin plant, the preheated feed would be mixed with dilution steam and then would pass from section 6, e.g., the convection section C of the furnace, directly into section 8 of FIG. 1, and then into the radiant section R of furnace 2. However, pursuant to this embodiment of the invention, the preheated feed (a mixture composed principally of distillate liquid and hydrocarbon vapor lighter than distillate, all from feed 5) passes instead by way of line 25, at a temperature of, for example, from about 200 to about 350 F, into standalone vaporization unit 26 that is, in this embodiment, physically located outside of furnace 2. Unit 26 is, however, in fluid communication with furnace 2. The preheated feed initially enters upper first zone 27 of unit 26 wherein the lighter, gaseous components present, e.g., naphtha and lighter, are separated from the accompanying still liquid components.

Unit 26 is a vaporization unit that is one component of the novel features of this invention. Unit 26 is not found in conjunction with conventional cracking furnaces. In the embodiment of FIG. 2, unit 26 receives preheated condensate from furnace 2 via line 25. In other embodiments of this invention preheat section 6 need not be used, and feed 5 fed directly into unit 26. Steam present in unit 26 provides both energy and a dilutive effect to achieve primarily (predominantly) vaporization of at least a significant portion of the naphtha and lighter components that remain in the liquid state in that unit. Gases that are associated with the preheated condensate feed as received by unit 26 are removed from zone 27 by way of line 28. Thus, line 28 carries away essentially all the lighter hydrocarbon vapors, e.g., naphtha boiling range and lighter materials, present in zone 27. Liquid distillate present in zone 27, with liquid naphtha, is removed there from via line 29 and passed into the upper interior of lower zone 30. Zones 27 and 30, in this embodiment, are separated from fluid communication with one another by an impermeable wall 31, which can be a solid tray. Line 29 represents external fluid down flow communication between zones 27 and 30. In lieu thereof, or in addition thereto, zones 27 and 30 can have internal fluid communication there between by modifying wall 31 to be at least in part liquid permeable by use of one or more tray(s) designed to allow liquid to pass down into the interior of zone 30 and vapor up into the interior of zone 27. For example, instead of an impermeable wall (or solid tray) 31, a chimney tray could be used in which case vapor carried by line 42 would instead pass through the chimney tray and leave unit 26 via line 28, and liquid 32 would pass internally within unit 26 down into section 30 instead of externally of unit 26 via line 29. In this internal down flow case, distributor 33 becomes optional.

By whatever way liquid is removed from zone 27 to zone 30, that liquid moves downwardly as shown by arrow 32, and thus encounters at least one liquid distribution device 33 as described hereinabove. Device 33 evenly distributes liquid across the transverse cross section of unit 26 so that the liquid will flow uniformly across the width of the tower into contact with, for example, packing 34. In this invention, packing 34 is devoid of materials such as catalyst that will promote mild cracking of hydrocarbons.

Dilution steam 7 passes through superheat zone 35, and then, via line 40 into a lower portion 54 of zone 30 below packing 34 wherein it rises as shown by arrow 41 into contact with packing 34. In packing 34 liquid 32 and steam 41 intimately mix with one another thus vaporizing some of liquid 32. This newly formed vapor, along with dilution steam 41, is removed from zone 30 via line 42 and added to the vapor in line 28 to form a combined hydrocarbon vapor product in line 43. Stream 42 can contain essentially hydrocarbon vapor from feed 5, e.g., naphtha and steam.

Stream 42 thus represents a part of feed stream 5 plus dilution steam 41, less liquid distillates from feed 5 that are present in stream 50. Stream 43 is passed through a mixed feed preheat zone 44 in a hotter (lower) section of convection zone C to further increase the temperature of all materials present, and then via cross over line 45 into radiant coil 9 in section R. Line 45 can be internal or external of furnace conduit 55.

Stream 7 can be employed entirely in zone 30, or a part thereof can be employed in either line 28 (via line 52) or line 43 (via line 53), or both to aid in the prevention of the formation of liquid in lines 28 and 43.

In section R the vaporous feed from line 45 which contains numerous varying hydrocarbon components is subjected to severe cracking conditions as aforesaid.

The cracked product leaves section R by way of line 10 for further processing in the remainder of the olefin plant downstream of furnace 2 as shown in FIG. 1.

Section 30 of unit 26 provides surface area for contacting liquid 32 with hot gas or gases, e.g., steam, 41. The counter current flow of liquid and gas within section 30 enables the heaviest (highest boiling point) liquids to be contacted at the highest hot gas to hydrocarbon ratio and with the highest temperature gas at the same time.

Thus, in the illustrative embodiment of FIG. 2, separated liquid hydrocarbon 29 contains most, if not all, of the distillate content of feed 5. Depending on the temperature of operation of section 27, liquid 29 can contain essentially only one or more distillate materials aforesaid or can contain such materials plus a finite amount of lighter materials such as naphtha. Sometimes it can be desirable to have a finite amount of naphtha in the distillate product, and this invention provides the flexibility to form a product stream 50 that is essentially only made up of distillate fractions or distillate fractions plus finite amounts of lighter fractions that make up stream 5.

Thus, if feedstock 5 boils in the range of from about 100 to about 650 F, and contains naphtha (boiling in the range of from about 100 to about 350 F) plus at least one distillate fraction (boiling, for example, mostly in the range of from about 350 to about 650 F) that feed can, pursuant to this invention, be preheated in unit 6 and further heated in unit 26 to vaporize essentially all the naphtha present for removal by way of lines 28 and 43. This would thereby leave essentially only liquid distillate to be recovered by way of line 50. The temperature of operation of units 6 and 26 to achieve this result can vary widely depending on the composition of feed 5, but will generally be in the range of from about 150 to about 450 F.

In the alternative, should it be desired to leave some naphtha in the liquid state with the distillate, as recovered by way of line 50, the temperature of operation of units 6, if used, and 26 can be altered to accomplish this result. When it is desired not to have essentially only distillate in stream 50, the amount of naphtha left in the liquid state for stream 50 can, with this invention, vary widely, but will generally be up to about 30 wt. % based on the total weight of naphtha, and distillates in stream 50. The temperature of operation of unit 6, if used, and unit 26 to achieve this result can vary widely depending on the composition of feed 5 and the amount of steam and pressure used, but will generally be in the range of from about 200 to about 450 F.

Stream 29 falls downwardly from zone 27 into lower, second zone 30, and can be vaporized as to any amounts of undesired liquid naphtha fractions initially present in zone 30. These gaseous hydrocarbons make their way out of unit 26 by way of line 42 due to the influence of hot gas, e.g., steam, 41 rising through zone 30 after being introduced into a lower portion, e.g., bottom half or one-quarter, of zone 30 (section 54) by way of line 40.

Of course, units 6 and 26 can be operated so as to leave some distillate in vaporous streams 28 and/or 42, if desired.

Feed 5 can enter furnace 2 at a temperature of from about ambient up to about 300 F at a pressure from slightly above atmospheric up to about 100 psig (hereafter "atmospheric to 100 psig"). Feed 5 can enter zone 27 via line 25 at a temperature of from about ambient to about 350 F at a pressure of from atmospheric to 100 psig.

Stream 28 can be essentially all hydrocarbon vapor formed from feed 5 and is at a temperature of from about ambient to about 400 F at a pressure of from atmospheric to 100 psig.

Stream 29 can be essentially all the remaining liquid from feed 5 less that which was vaporized in pre-heater 6 and is at a temperature of from about ambient to about 400 F at a pressure of from slightly above atmospheric up to about 100 psig (hereafter "atmospheric to 100 psig").

The combination of streams 28 and 42, as represented by stream 43, can be at a temperature of from about 170 to about 400 F at a pressure of from atmospheric to 100 psig, and contain, for example, an overall steam/hydrocarbon ratio of from about 0.1 to about 2, preferably from about 0.1 to about 1, pounds of steam per pound of hydrocarbon.

Stream 45 can be at a temperature of from about 900 to about 1,100 F at a pressure of from atmospheric to 100 psig.

Liquid distillate 50 can contain essentially only distillate components, or can be a mixture of distillate components and lighter components found in streams 28 and/or 43. Distillate stream 50 can be at a temperature of less than about 550 F at a pressure of from atmospheric to 100 psig.

In zone 30, dilution ratios (hot gas/liquid droplets) will vary widely because the composition of condensate varies widely. Generally, the hot gas 41, e.g., steam, to hydrocarbon ratio at the top of zone 30 can be from about 0.1/1 to about 5/1, preferably from about 0.1/1 to about 1.2/1, more preferably from about 0.1/1 to about 1/1.

Steam is an example of a suitable hot gas introduced by way of line 40. Other materials can be present in the steam employed. Stream 7 can be that type of steam normally used in a conventional cracking plant. Such gases are preferably at a temperature sufficient to volatilize a substantial fraction of the liquid hydrocarbon 32 that enters zone 30. Generally, the gas entering zone 30 from conduit 40 will be at least about 350 F, preferably from about 650 to about 850 F at from atmospheric to 100 psig. Such gases will, for sake of simplicity, hereafter be referred to in terms of steam alone.

Stream 42 can be a mixture of steam and hydrocarbon vapor that has a boiling point lower than about 350 F. It should be noted that there may be situations where the operator desires to allow some distillate to enter stream 42, and such situations are within the scope of this invention. Stream 42 can be at a temperature of from about 170 to about 450 F at a pressure of from atmospheric to 100 psig.

Packing and/or trays 34 provide surface area for the steam entering from line 41. Section 34 thus provides surface area for contacting down flowing liquid with up flowing steam 41 entering from line 40. The counter current flow within section 30 enables the heaviest (highest boiling point) liquids to be contacted at the highest steam to oil ratio and, at the same time, with the highest temperature steam.

It can be seen that steam from line 40 does not serve just as a diluent for partial pressure purposes as does diluent steam that may be introduced, for example, into conduit 5 (not shown). Rather, steam from line 40 provides not only a diluting function, but also additional vaporizing energy for the hydrocarbons that remain in the liquid state. This is accomplished with just sufficient energy to achieve vaporization of heavier hydrocarbon components and by controlling the energy input. For example, by using steam in line 40, substantial vaporization of feed 5 liquid is achieved. The very high steam dilution ratio and the highest temperature steam are thereby provided where they are needed most as liquid hydrocarbon droplets move progressively lower in zone 30.

Unit 26 of FIG. 2, instead of being a standalone unit outside furnace 2, can be physically contained within the interior of convection zone C so that zone 30 is wholly within the interior of furnace 2. Although total containment of unit 26 within a furnace may be desirable for various furnace design considerations, it is not required in order to achieve the benefits of this invention. Unit 26 could also be employed wholly or partially outside of the furnace and still be within the spirit of this invention. Combinations of wholly interior and wholly exterior placement of unit 26 with respect to furnace 2 will be obvious to those skilled in the art and also are within the scope of this invention.

EXAMPLE

A natural gas condensate stream 5 characterized as Bejaia condensate from Algeria is removed from a storage tank and fed directly into the convection section of a pyrolysis furnace 2 at ambient conditions of temperature and pressure. In this convection section this condensate initial feed is preheated to about 280 F at about 60 psig, and then passed into a vaporization unit 26 wherein a mixture of gasoline and naphtha gases at about 280 F and 60 psig are separated from distillate liquids in zone 27 of that unit. The separated gases are removed from zone 27 for transfer to the radiant section of the same furnace for severe cracking in a temperature range of 1,450° F. to 1,550° F. at the outlet of radiant coil 9.

The hydrocarbon liquid remaining from feed 5, after separation from accompanying hydrocarbon gases aforesaid, is transferred to lower section 30 and allowed to fall downwardly in that section toward the bottom thereof. Preheated steam 40 at about 660 F is introduced near the bottom of zone 30 to give a steam to hydrocarbon ratio in section 54 of about 1.5. The falling liquid droplets are in counter current flow with the steam that is rising from the bottom of zone 30 toward the top thereof. With respect to the liquid falling downwardly in zone 30, the steam to liquid hydrocarbon ratio increases from the top to bottom of section 34.

A mixture of steam and naphtha vapor 42 at about 250 F is withdrawn from near the top of zone 30 and mixed with the gases earlier removed from zone 27 via line 28 to form a composite steam/hydrocarbon vapor stream containing about 0.45 pounds of steam per pound of hydrocarbon present. This composite stream is preheated in zone 44 to about 1,000 F at less than about 50 psig, and introduced into the radiant section R of furnace 2.

I claim:

1. In a method for operating an olefin production plant that employs a pyrolysis furnace to thermally crack hydrocarbon materials for the subsequent processing of said cracked materials in said plant, said furnace having in its interior at least a convection heating section and a separate radiant heating section, said radiant heating section being employed for said cracking, the improvement comprising providing natural gas condensate liquid as the primary feedstock to said furnace, said feedstock consisting essentially of at least one distillate and hydrocarbons that boil at temperatures lower than said at least one distillate, (1) directing said feedstock to a first zone of a vaporization unit and separating a portion of said feedstock in said first zone into a first vapor stream consisting essentially of only hydrocarbons that boil at a temperature lower than said at least one distillate while leaving a first liquid stream consisting essentially of said at least one distillate and remaining hydrocarbons that boil at a temperature lower than said at least one distillate, and (2) passing said first liquid stream to a second zone of said vaporization unit, (3) contacting said first liquid stream with steam in said second zone so that said first liquid stream mixes with said steam to produce a second vapor stream consisting essentially of only remaining hydrocarbons that boil at temperatures lower than said at least one distillate, and a second liquid stream consisting essentially of only said at least one distillate, (4) passing at least one of said first vapor stream and said second vapor stream to said cracking furnace, and (5) recovering said second liquid stream containing said at least one distillate from said second zone and disposing of said second liquid stream other than in said cracking furnace.

2. The method of claim 1 wherein said recovered liquid hydrocarbons are added to a distillate pool.

3. The method of claim 1 wherein said feedstock boils in a temperature range of from about 100 to about 650 F, and contains A) at least one of naphtha, and B) at least one distillate selected from the group consisting of kerosene, diesel fuel, and gas oil.

4. The method of claim 3 wherein said feedstock is heated to vaporize essentially all said naphtha.

5. The method of claim 4 wherein said feedstock is heated to a temperature of from about 150 to about 450 F.

6. The method of claim 3 wherein said feedstock is heated to vaporize a significant portion of said naphtha but leaving finite amounts of naphtha in the liquid state and mixed with said at least one liquid distillate.

7. The method of claim 6 wherein said feedstock is heated to a temperature of from about 200 to about 450 F.

* * * * *